US007201286B2

(12) United States Patent
Wang

(10) Patent No.: US 7,201,286 B2
(45) Date of Patent: Apr. 10, 2007

(54) FOLDING COLLAPSIBLE STORAGE BOX

(76) Inventor: Wen-Tsan Wang, PO Box 82-144, Taipei (TW)

( * ) Notice: Subject to any disclaimer, the term of this patent is extended or adjusted under 35 U.S.C. 154(b) by 554 days.

(21) Appl. No.: 10/704,584

(22) Filed: Nov. 12, 2003

(65) Prior Publication Data

US 2005/0098555 A1 May 12, 2005

(51) Int. Cl.
*B65D 6/24* (2006.01)

(52) U.S. Cl. ..... 220/9.4

(58) Field of Classification Search ..... None
See application file for complete search history.

(56) References Cited

U.S. PATENT DOCUMENTS 1,043,572 A * 11/1912 Donley ..... 206/174

4,585,159 A * 4/1986 Travis ..... 229/166

* cited by examiner

*Primary Examiner*—Stephen J. Castellano
(74) *Attorney, Agent, or Firm*—Leong C. Lei

(57) ABSTRACT

A folding collapsible storage box is constructed to include a plurality of box units connected to one another in a line, each box unit including a folding collapsible rectangular top-open box body, two hard side boards respectively fastened to two adjacent upright peripheral panels of the box body, a hard bottom panel attached to the bottom panel of the box body, and a plurality of rod members horizontally fastened to the topmost edge of each upright peripheral panel that is not attached with a hard side board. Further, the box bodies of each two adjacent box units have a bottom upright peripheral panel.

2 Claims, 9 Drawing Sheets

FOLDING COLLAPSIBLE STORAGE BOX

BACKGROUND OF THE INVENTION

1. Field of the Invention

The present invention relates to a storage box for keeping things and, more particularly, to a folding collapsible storage box which is comprised of a plurality of folding collapsible box units connected in a line.

2. Description of the Related Art

Various folding collapsible storage containers have been disclosed, and have appeared on the market. There is known a storage container made of soft fabric and supported in shape with a support frame, which is comprised of horizontal bottom rods, horizontal top rods, and vertical rods spaced between the horizontal bottom rods and the horizontal top rods at the four corners. Further, the peripheral side panels of the storage container each have a crossed folding line through which the storage container can easily be folded up and set into a flat manner. This folding collapsible storage container has a complicated structure. It is also not easy to set the folding collapsible storage container between the operative status and the collapsed status. Besides, the rod members do not support the peripheral side panels of the storage container in a stretched manner, i.e. the fabric peripheral side panels of the storage container are constantly disposed is a loosed status. In case the storage container is equipped with a handle or handles, the handle(s) may hinder the folding of the storage container. Further, this structure of storage container has only a limited space for keeping things.

There is known another structure of folding collapsible storage container, which is comprised of two box units. Each box unit is comprised of a folding collapsible rectangular box body made of soft fabric, a hard bottom board attached to the bottom panel of the box body, and four rod members respectively fastened to the four corners of the box body in vertical. Further, the two box units use two common rod members. This design of folding collapsible storage container still has drawbacks. One drawback of this design of folding collapsible storage container is that the rod members cannot support the soft upright peripheral panels of the folding collapsible rectangular box body in a stretched smooth status. Another drawback of this design of folding collapsible storage container is its complicated collapsing procedure. When collapsing the folding collapsible storage container, the user must take out the hard bottom boards. Because the hard bottom boards are not fastened to the respective box body, they may be forced out of place when folding the folding collapsible storage container.

SUMMARY OF THE INVENTION

The present invention has been accomplished to provide a folding collapsible storage box that eliminates the aforesaid drawbacks. According to one aspect of the present invention, the folding collapsible storage box is comprised of a plurality of box units connected to one another in a line. Each box unit comprises a folding collapsible box body, which has a bottom panel, a top open side, and a plurality of upright peripheral panels, two hard side boards respectively fastened to two adjacent upright peripheral panels of the box body, a hard bottom panel attached to the bottom panel of the box body, and a plurality of rod members horizontally fastened to the topmost edge of each upright peripheral panel that is not attached with a hard side board. Further, the box bodies of each two adjacent box units have a bottom upright peripheral panel. According to another aspect of the present invention, the common upright peripheral panel of each two adjacent box units has a bottom opening; the two bottom hard boards of each two adjacent box units are connected together by a flexible connecting member that extends through the bottom opening of the corresponding common upright peripheral panel. Alternatively, the two bottom hard boards of each two adjacent box units may be respectively hinged to the bottom side of the corresponding common upright peripheral panel. Further, the box body of each box unit may be provided with a side pocket for keeping small items.

DETAILED DESCRIPTION OF THE PREFERRED EMBODIMENT

Figure 1:
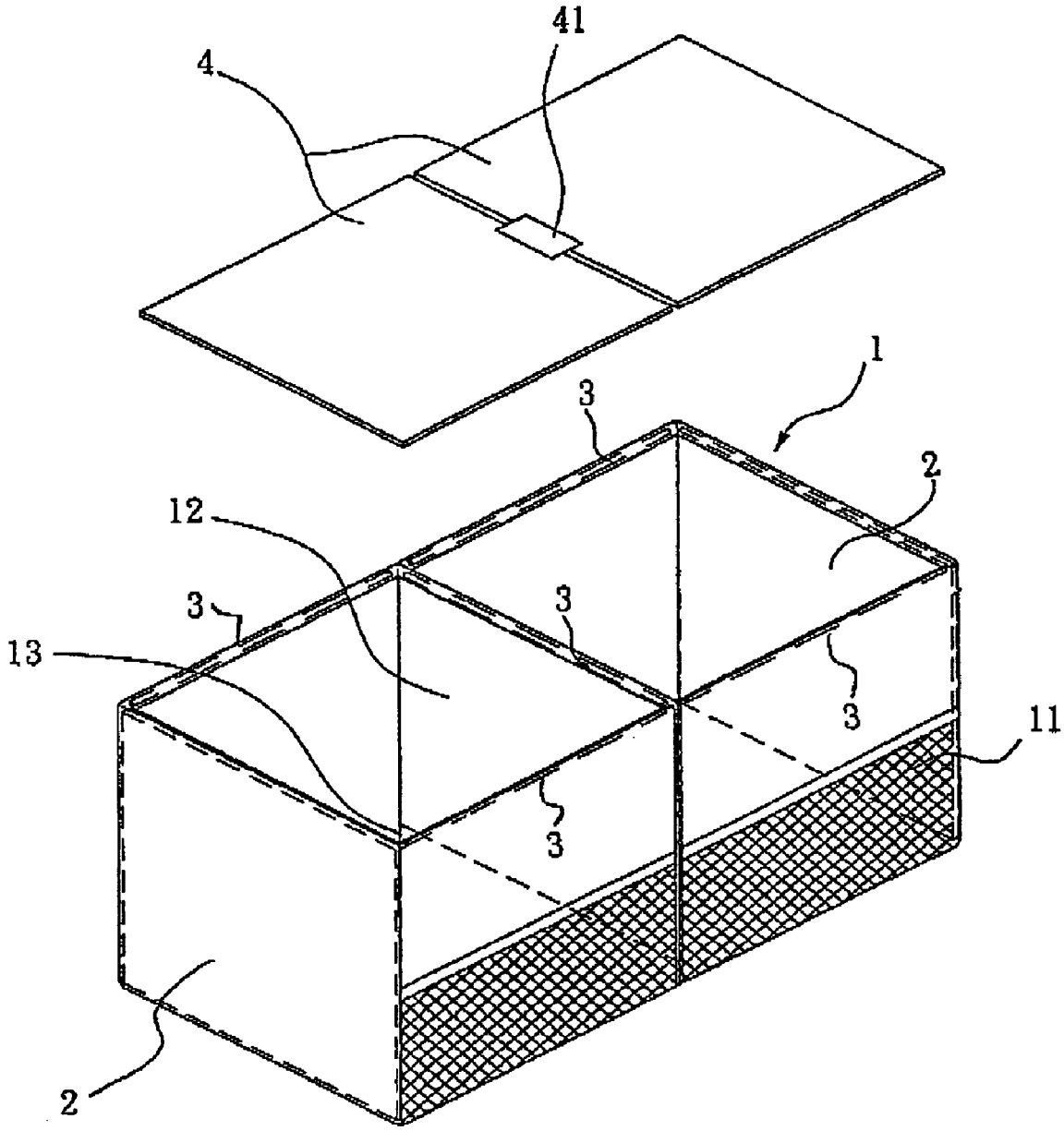
FIG. 1 is an exploded view of a folding collapsible storage box according to the first embodiment of the present invention.
Figure 2:
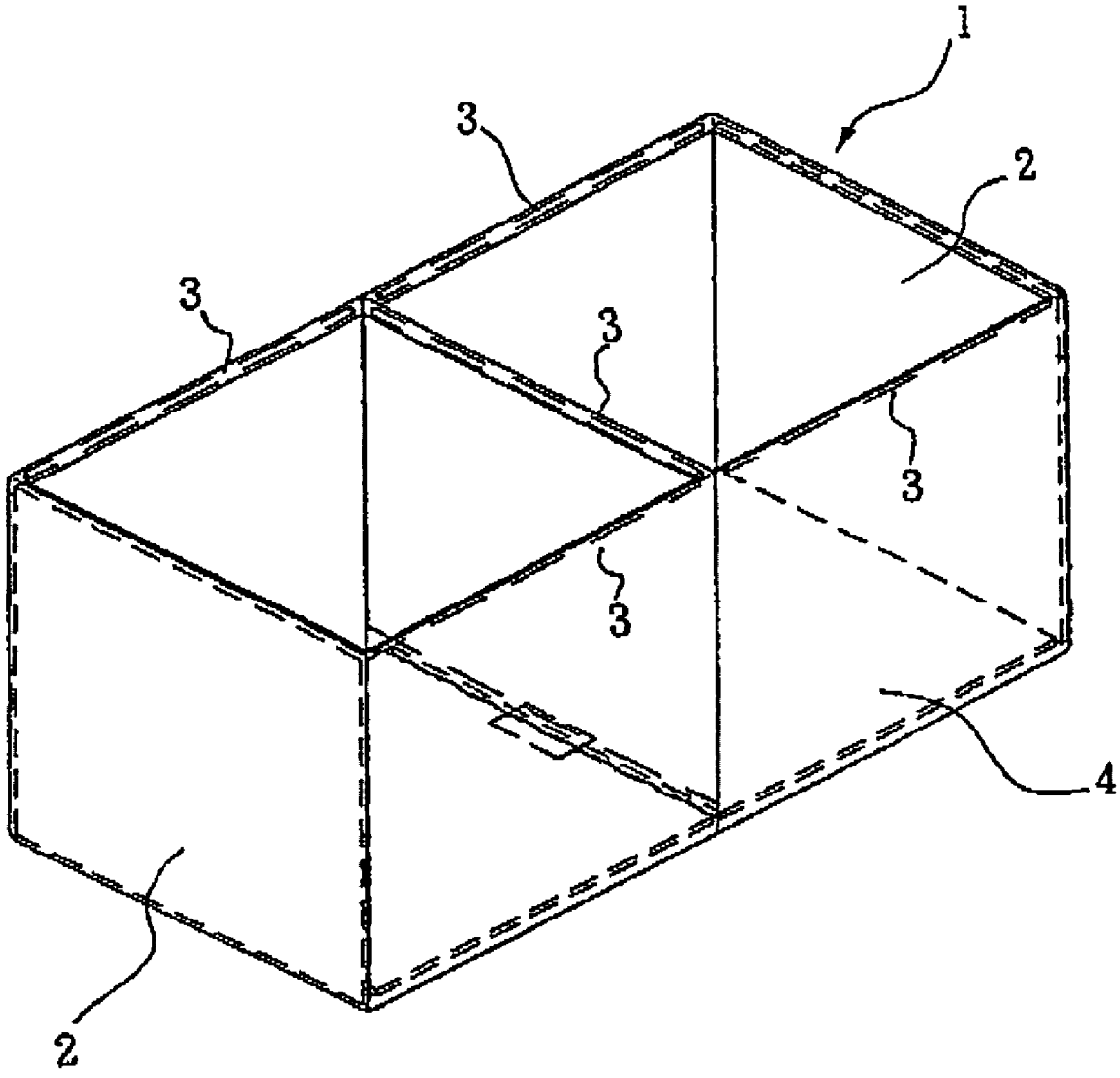
FIG. 2 is a perspective assembly view of the folding collapsible storage box according to the first embodiment of the present invention.

Referring to FIGS. 1 and 2, a folding collapsible storage box in accordance with the first embodiment of the present invention is shown comprised of two box units connected side by side. Each box unit is comprised of a collapsible rectangular top-open box body 1, two hard side boards 2, a plurality of rod members 3, and a hard bottom board 4. The collapsible box body 1 is made of tough fabric, for example, canvass, having a bottom panel, a top open side, and four upright peripheral panels. The box bodies 1 of the two box units are fastened together with stitches, having a common upright peripheral panel 12. The common upright peripheral panel 12 has a narrow bottom opening 13 horizontally extended along the width. The two hard side boards 2 are respectively fastened to (for example, embedded in) two upright peripheral panels 12 at two opposite sides of the storage box. The rod members 3 are respectively horizontally fastened to the topmost edge of each of the other upright peripheral panels not attached with a hard side board. The hard bottom board 4 is fitted into the inside of the box body 1 and closely attached to the bottom panel of the box body 1. Further, the two hard bottom boards 4 of the two box units are linked by a flexible connecting member 41, which is inserted through the narrow bottom opening 13 of the common upright peripheral panel 12. Further, a side pocket 11 may be provided at the outer side of the box body 1 for holding small items.

When extended out the box body 1 of each box unit, the hard side boards 2 and the hard bottom board 4 support the box body 1 of the respective box unit in shape (see FIG. 2).

Figure 3:
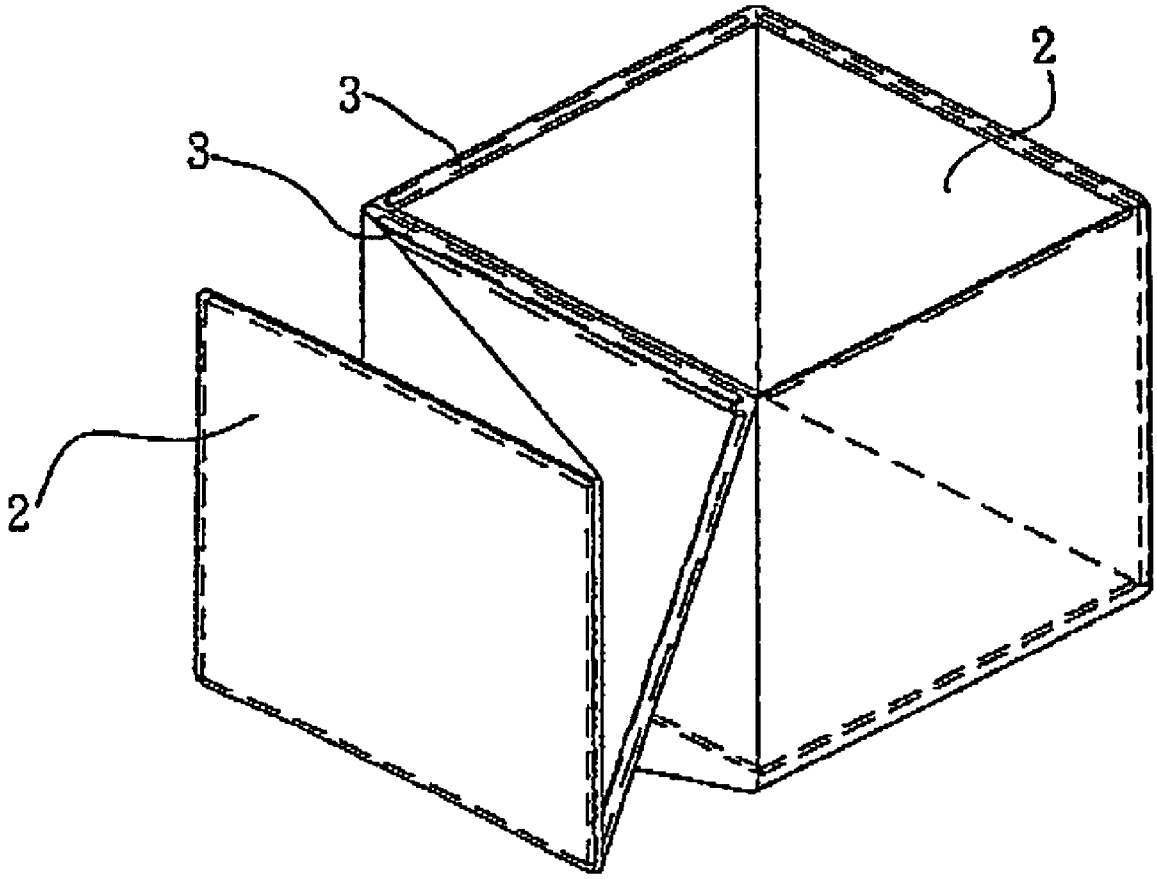
FIG. 3 is a schematic drawing showing the collapsing operation of the folding collapsible storage box according to the first embodiment of the present invention (I).
Figure 4:
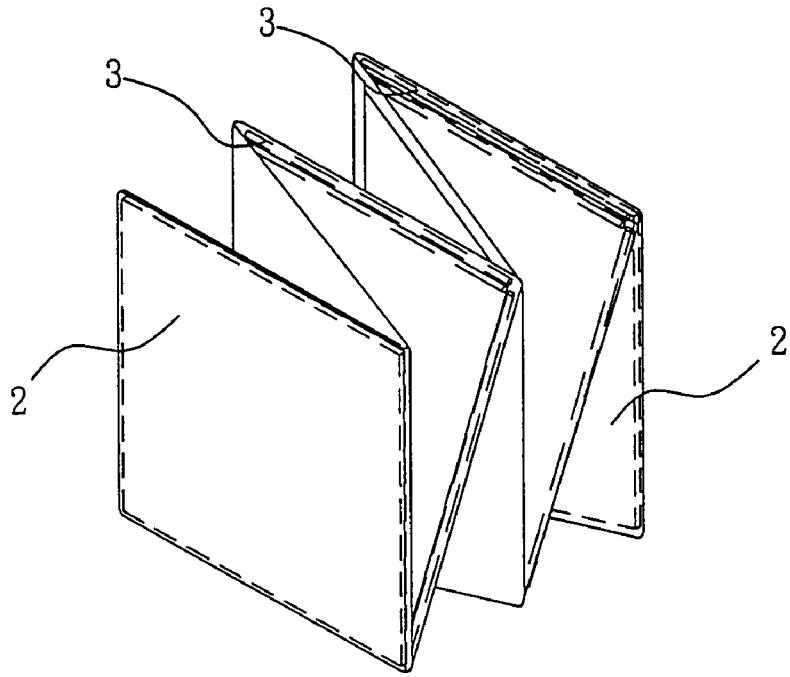
FIG. 4 is a schematic drawing showing the collapsing operation of the folding collapsible storage box according to the first embodiment of the present invention (II).
Figure 5:
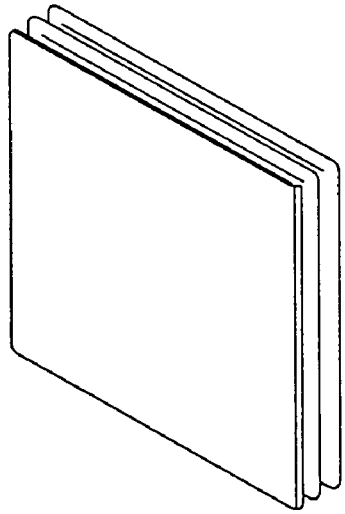
FIG. 5 is a schematic drawing showing the folding collapsible storage box received in a flat manner according to the first embodiment of the present invention.

When wishing to collapse the box body 1, turn the hard bottom board 4 of one box unit upwards and then attach the hard bottom board 4 to one upright peripheral panel of the box body 1 of the respective box unit, and then twist the box body 1 through 90° to collapse the box body 1 of the respective box unit (see FIG. 3), and then collapse the other box unit in the same way (see FIG. 4), thereby causing the folding collapsible storage box to be received in a flat manner (see FIG. 5).

Figure 6:
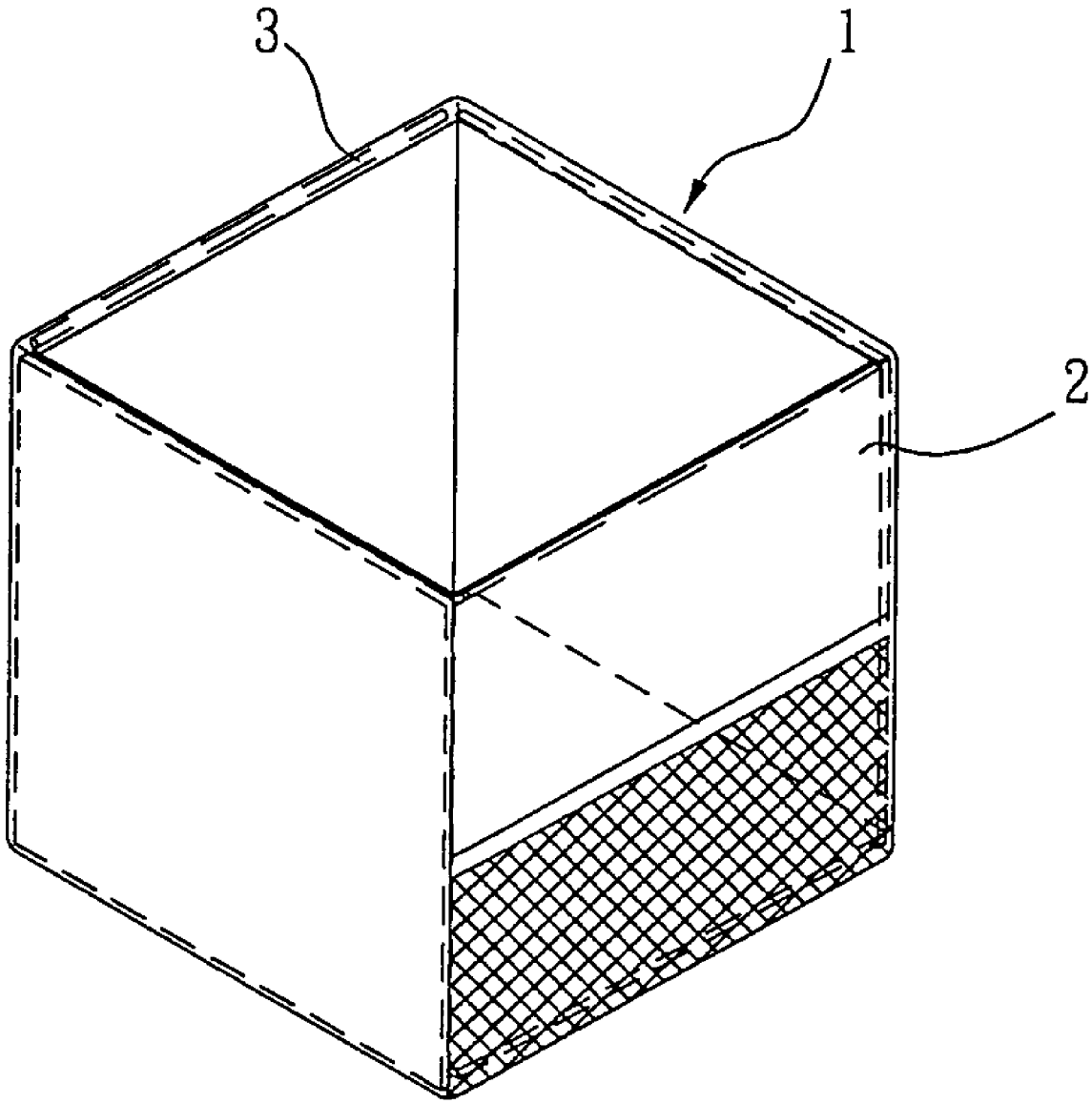
FIG. 6 is a perspective view of a folding collapsible storage box according to the second embodiment of the present invention.

FIG. 6 shows a folding collapsible storage box according to the second embodiment. According to this embodiment, the folding collapsible storage box is comprised of one single box unit, which is comprised of a collapsible box body 1, two hard side boards 2 fastened to two adjacent upright peripheral panels of the box body 1, two rod members 3 respectively horizontally fastened to the other two upright peripheral panels of the box body 1, and a hard bottom board fastened to the bottom panel of the box body 1.

Figure 7:
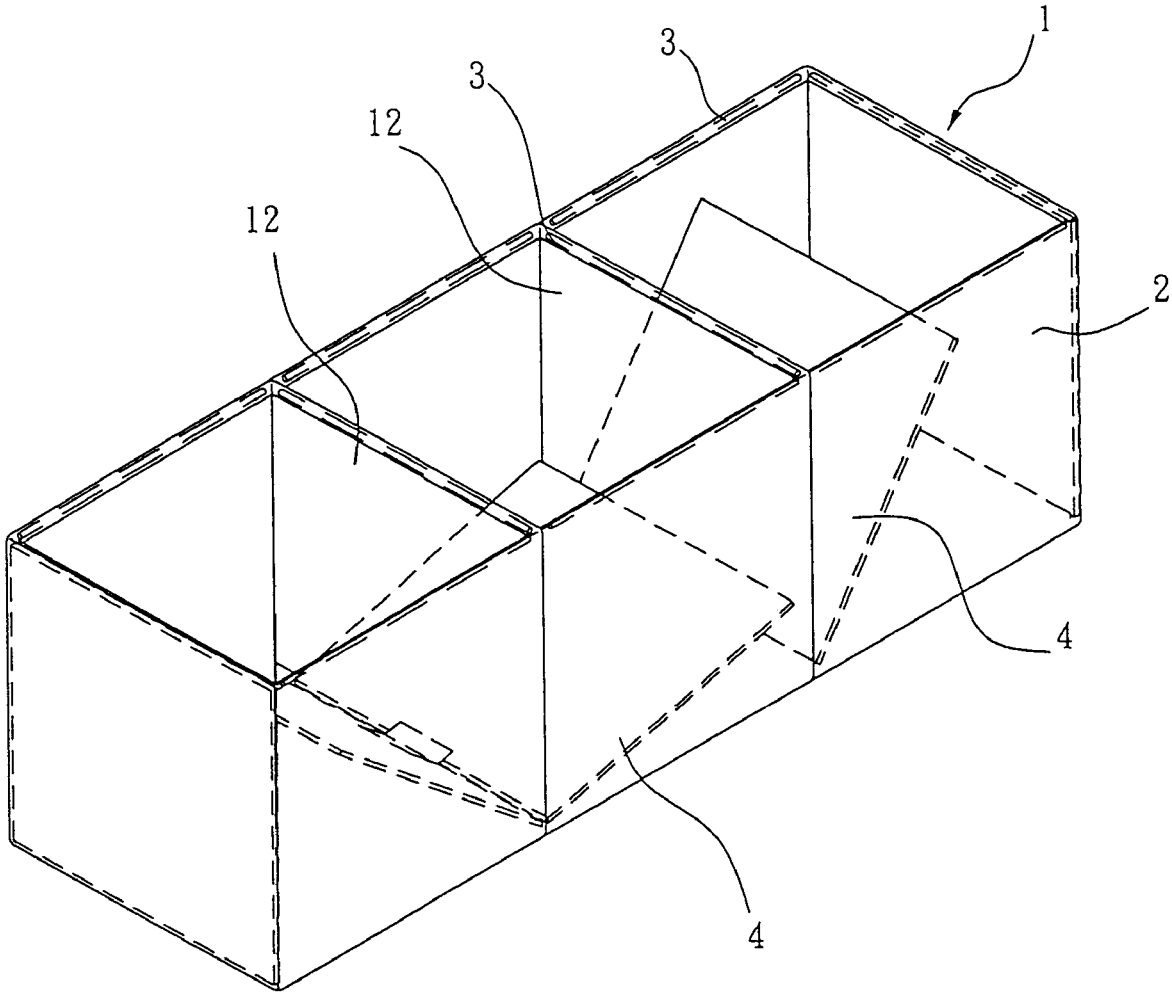
FIG. 7 is a perspective view of a folding collapsible storage box according to the third embodiment of the present invention.

FIG. 7 shows a folding collapsible storage box according to the third embodiment of the present invention. According to this embodiment, the folding collapsible storage box is comprised of three box units connected side to side in a line. Similar to the aforesaid first embodiment of the present invention, each two adjacent box units have a bottom upright peripheral panel 12, and the hard bottom boards 4 of the box units are connected to one another by a respective flexible connecting member.

Figure 8:
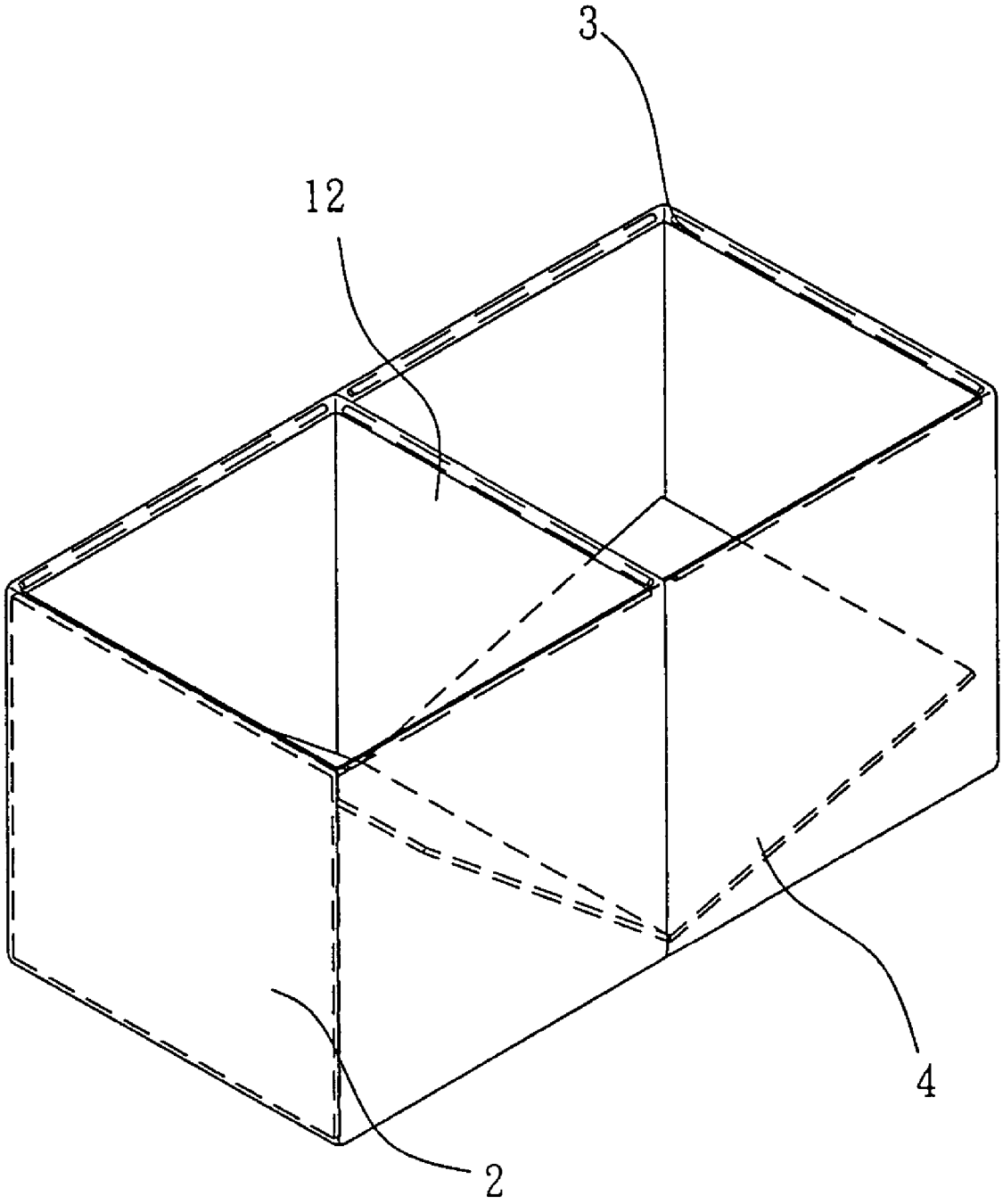
FIG. 8 is a perspective view of a folding collapsible storage box according to the fourth embodiment of the present invention.

FIG. 8 is a perspective view of a folding collapsible storage box according to the fourth embodiment of the present invention. This embodiment is similar to the aforesaid first embodiment with the exception that the common upright peripheral panel 12 does not have the aforesaid narrow bottom opening 13, and the two hard bottom panels 4 of the two box units are respectively hinged to the bottom side of the common upright peripheral panel 12.

Figure 9:
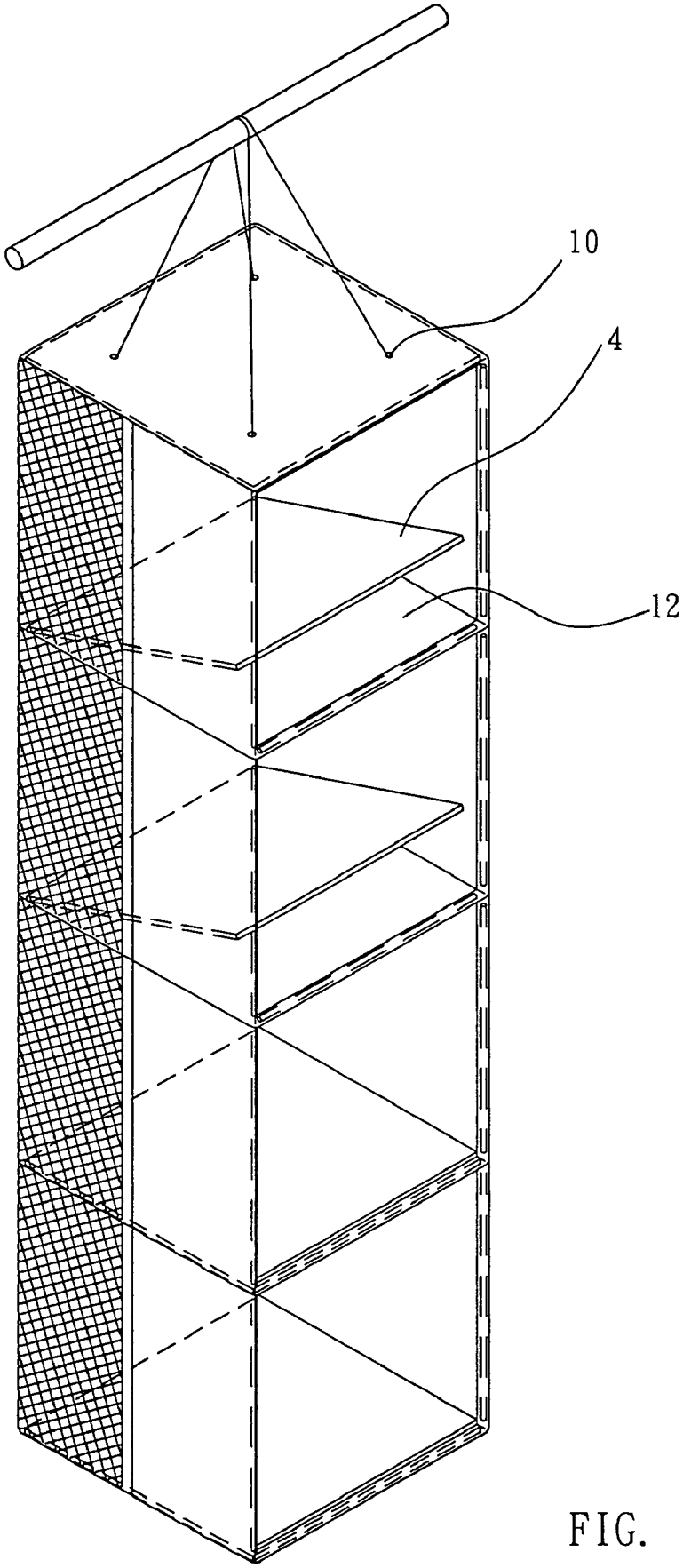
FIG. 9 is perspective view of a folding collapsible storage box according to the fifth embodiment of the present invention.

FIG. 9 is perspective view of a folding collapsible storage box according to the fifth embodiment of the present invention. This embodiment is comprised of a number of box units connected in a line, and the leading box unit of the folding collapsible storage box has a plurality of tie holes 16 for the mounting of hanging wires adapted to hang the folding collapsible storage box on an overhead rod.

Figure 10:
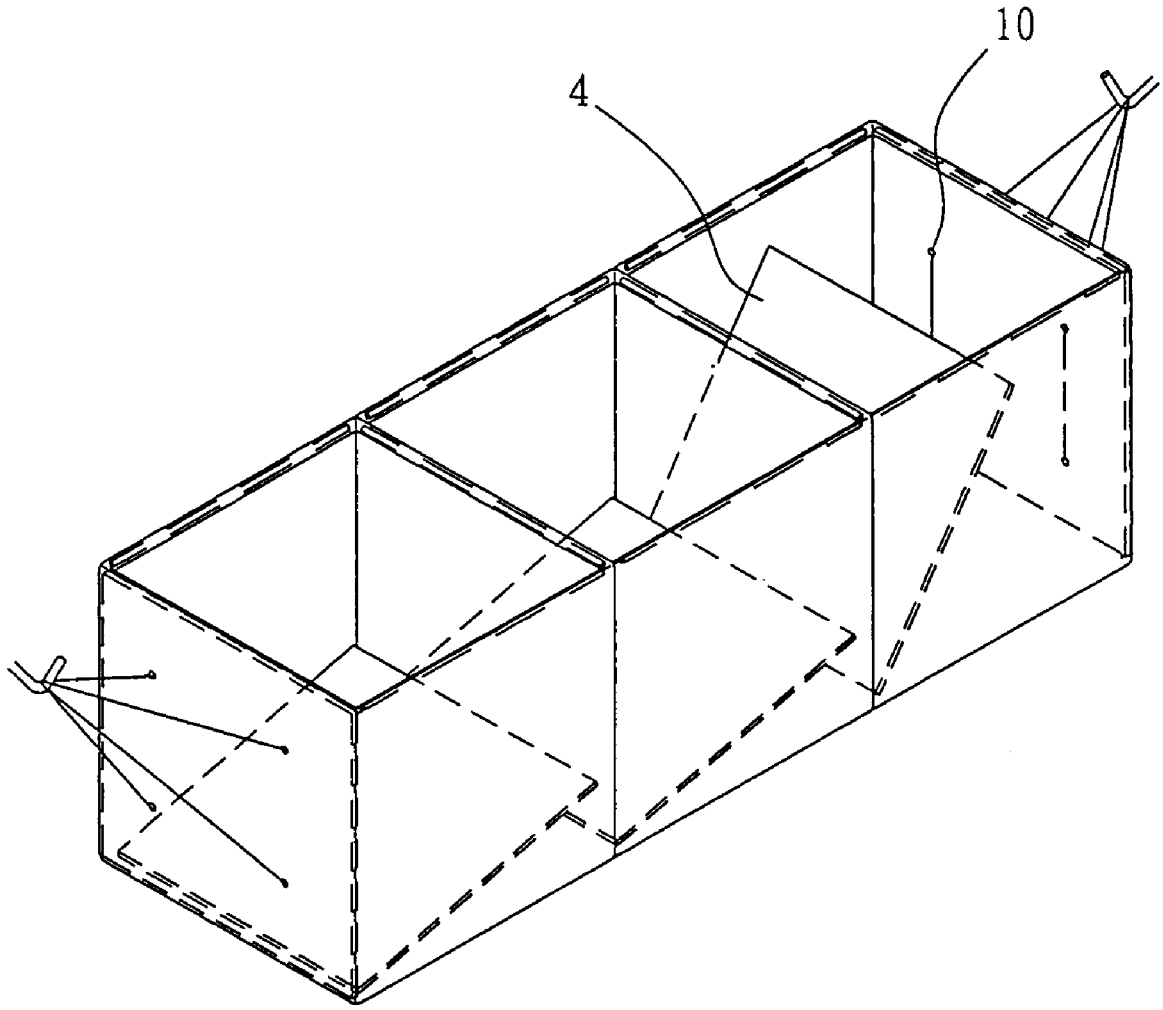
FIG. 10 is perspective view of a folding collapsible storage box according to the sixth embodiment of the present invention.

FIG. 10 is perspective view of a folding collapsible storage box according to the sixth embodiment of the present invention. This embodiment is comprised of a number of box units connected in a line, and the first and last box units of the folding collapsible storage box each have a plurality of tie holes 16 for the mounting of hanging wires adapted to hang the folding collapsible storage box between two vertical walls.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A folding collapsible storage box comprising:

a first collapsible box unit, said first collapsible box unit having a collapsible box body, said first collapsible box body being made of fabric and having an open top, a bottom panel, and four upright peripheral panels;

a second collapsible box unit stitched with said first collapsible box unit in a line to form a storage box, said second collapsible box unit having a collapsible box body, said collapsible box body being made of fabric and having an open top, a bottom panel, and four upright peripheral panels, said first and second box units having a common upright peripheral panel, said common upright peripheral panel having a narrow bottom opening;

two hard side boards attached to two opposite sides of said storage box;

a plurality of rod members respectively horizontally fastened to a topmost edge of said upright peripheral panels not attached with said hard side boards;

two hard bottom boards attached to said bottom panel of said box body, said two hard bottom boards being linked by a flexible connecting member which extends through said bottom opening of said common upright peripheral panel;

whereby when desired to collapse said storage box, turn one of said hard bottom boards of upwards to attach to one of said upright peripheral panels of said first collapsible unit, twist said box body through 90 degrees to collapse said box body of said first collapsible unit, and then collapse said box body of said second collapsible unit in the same way, thereby causing said storage box to be received in a flat manner.

2. The folding collapsible storage box as claimed in claim 1, wherein said box body of said box units has a side pocket.

* * * * *